US009046262B2

(12) United States Patent
Kim et al.

(10) Patent No.: US 9,046,262 B2
(45) Date of Patent: Jun. 2, 2015

(54) PREMIXER FUEL NOZZLE FOR GAS TURBINE ENGINE

(75) Inventors: Kwanwoo Kim, Cincinnati, OH (US); Nishant Govindbhai Parsania, Bangalore (IN); Ajay Pratap Singh, Bangalore (IN)

(73) Assignee: General Electric Company, Schenectady, NY (US)

( * ) Notice: Subject to any disclaimer, the term of this patent is extended or adjusted under 35 U.S.C. 154(b) by 1010 days.

(21) Appl. No.: 13/170,133

(22) Filed: Jun. 27, 2011

(65) Prior Publication Data

US 2012/0324896 A1 Dec. 27, 2012

(51) Int. Cl.

| | |
|---|---|
| ***F02C 7/22*** | (2006.01) |
| ***F23R 3/14*** | (2006.01) |
| ***F23C 7/00*** | (2006.01) |
| ***F23R 3/28*** | (2006.01) |

(52) U.S. Cl.

CPC ..... *F23C 7/004* (2013.01); *F23C 2900/07001* (2013.01); *F23R 3/286* (2013.01)

(58) Field of Classification Search

CPC ..... F23R 3/286; F23R 3/14; F23R 3/28; F23R 3/10; F23D 2900/14004; F23C 7/004; F23C 2900/07001

USPC ..... 60/748, 746, 742, 739, 738, 737, 734; 239/399

See application file for complete search history.

(56) References Cited

U.S. PATENT DOCUMENTS

| | | | | |
|---|---|---|---|---|
| 2,249,489 | A * | 7/1941 | Noack | 432/55 |
| 5,251,447 | A | 10/1993 | Joshi et al. | |
| 5,351,477 | A * | 10/1994 | Joshi et al. | 60/39.463 |
| 5,813,232 | A * | 9/1998 | Razdan et al. | 60/737 |
| 6,038,864 | A * | 3/2000 | Prade et al. | 60/748 |
| 6,216,466 | B1 * | 4/2001 | Alkabie | 60/746 |
| 6,438,961 | B2 * | 8/2002 | Tuthill et al. | 60/776 |
| 6,691,516 | B2 * | 2/2004 | Stuttaford et al. | 60/737 |
| 6,786,047 | B2 * | 9/2004 | Bland et al. | 60/737 |
| 6,993,916 | B2 | 2/2006 | Johnson et al. | |
| 7,007,477 | B2 | 3/2006 | Widener | |
| 7,171,813 | B2 | 2/2007 | Tanaka et al. | |
| 7,360,363 | B2 * | 4/2008 | Mandai et al. | 60/737 |
| 2006/0080966 | A1 | 4/2006 | Widener | |

(Continued)

FOREIGN PATENT DOCUMENTS

EP 0870989 A2 10/1998

OTHER PUBLICATIONS

Search Report and Written Opinion from EP Application No. 12173064.2 dated Oct. 29, 2012.

*Primary Examiner* — William H Rodriguez
*Assistant Examiner* — Steven Sutherland
(74) *Attorney, Agent, or Firm* — Fletcher Yoder P.C.

(57) ABSTRACT

In an embodiment, a system includes a turbine fuel nozzle having a hub with an axis, a shroud surrounding the hub along the axis, an air flow path between the hub and the shroud, and a fuel flow path. The turbine fuel nozzle also includes a swirl vane extending between the hub and the shroud in a radial direction relative to the axis. The swirl vane includes a fuel inlet coupled to the fuel flow path, a fuel chamber extending from the fuel inlet, and a plurality of fuel outlets extending from the fuel chamber to the air flow path. The plurality of fuel outlets is positioned at an axial distance of at least approximately ⅔ of an axial length of the fuel chamber downstream from an upstream point along an upstream edge of the fuel chamber.

23 Claims, 3 Drawing Sheets

(56) References Cited

U.S. PATENT DOCUMENTS

2007/0277530 A1 12/2007 Dinu et al.
2009/0183511 A1 7/2009 Dinu
2009/0255263 A1* 10/2009 Doerr et al. ..... 60/746
2010/0077760 A1* 4/2010 Laster et al. ..... 60/742
2010/0095675 A1 4/2010 Lacy et al.
2010/0199675 A1 8/2010 Dinu et al.

* cited by examiner

PREMIXER FUEL NOZZLE FOR GAS TURBINE ENGINE

BACKGROUND OF THE INVENTION

The subject matter disclosed herein relates to fuel nozzles for gas turbine engines, and more specifically, to premixing fuel and air in the fuel nozzles.

A gas turbine engine combusts a mixture of fuel and air to generate hot combustion gases, which in turn drive one or more turbines. In particular, the hot combustion gases force turbine blades to rotate, thereby driving a shaft to rotate one or more loads, such as an electrical generator. Gas turbine engines typically include one or more fuel nozzles to inject a fuel into a combustor. For example, the fuel nozzle may premix fuel and air to inject a fuel-air mixture into the combustor. The degree of mixing can substantially impact the combustion process, and can lead to greater emissions if not sufficient. Unfortunately, the distribution of fuel into air within the fuel nozzle may be non-uniform due to various design constraints.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine fuel nozzle having a hub with an axis, a shroud surrounding the hub along the axis, an air flow path between the hub and the shroud, and a fuel flow path. The turbine fuel nozzle also includes a swirl vane extending between the hub and the shroud in a radial direction relative to the axis. The swirl vane includes a fuel inlet coupled to the fuel flow path, a fuel chamber extending from the fuel inlet, and a plurality of fuel outlets extending from the fuel chamber to the air flow path. The plurality of fuel outlets is positioned at an axial distance of at least approximately ⅔ of an axial length of the fuel chamber downstream from an upstream point along an upstream edge of the fuel chamber.

In a second embodiment, a system includes a fuel nozzle. The fuel nozzle includes a hub, a shroud disposed about the hub, an air flow path between the hub and the shroud, and a fuel flow path disposed along the hub. The fuel nozzle also includes a swirl vane disposed between the hub and the shroud. The swirl vane includes a fuel inlet along the hub, a fuel chamber extending between the hub and the shroud, and a plurality of fuel outlets between the hub and the shroud. The plurality of fuel outlets is offset by at least a minimum distance from a minimum pressure point of a recirculation zone in the fuel chamber, and the minimum distance is configured to increase uniformity of fuel flow through the plurality of fuel outlets.

In a third embodiment, a system includes a fuel nozzle swirl vane. The fuel nozzle swirl vane includes an exterior having a leading edge and a trailing edge relative to an air flow path. The fuel nozzle swirl vane also includes an interior fuel chamber having an upstream edge facing the leading edge and a downstream edge facing the trailing edge. The fuel nozzle swirl vane also includes a fuel inlet into the interior fuel chamber adjacent the upstream edge and a plurality of fuel outlets extending from the interior fuel chamber to the exterior. The plurality of fuel outlets is positioned at a distance of at least approximately ⅔ of a length of the interior fuel chamber downstream from an upstream point along the upstream edge of the fuel chamber.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
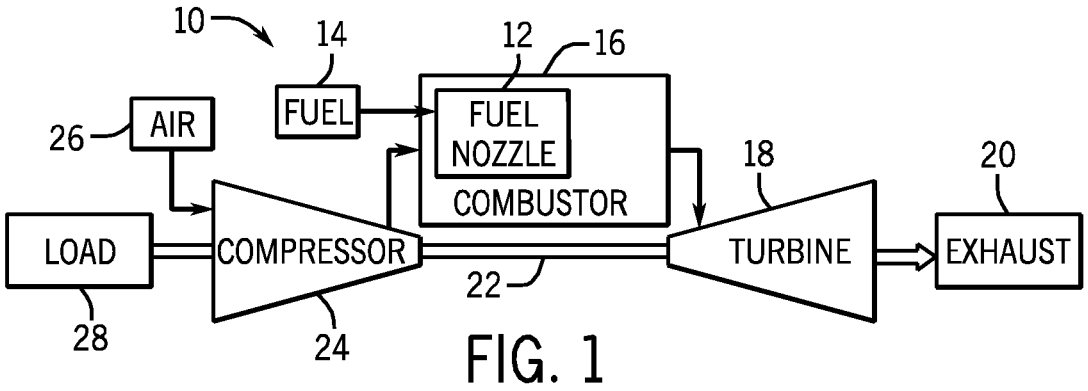
FIG. 1 is a block diagram of an embodiment of a turbine system having a fuel nozzle assembly improved air-fuel mixing.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments relate to fuel nozzle assemblies (e.g., turbine fuel nozzles) having improved air-fuel mixing for various combustion systems, such as gas turbine engines and turbine combustors. In particular, a fuel nozzle may be provided with a plurality of swirl vanes along an air flow path (e.g., an annular air flow path), wherein each swirl vane is configured to inject fuel uniformly into the air flow path. For example, each swirl vane may include an internal fuel chamber shaped to distribute the fuel pressure more uniformly, thereby helping to distribute the fuel flow more uniformly through a plurality of fuel outlets. For example, an upstream edge of the internal fuel chamber may be tapered or curved to reduce low pressure regions within the chamber, while also guiding the fuel flow more uniformly toward the plurality of fuel outlets. By further example, the plurality of fuel outlets may be positioned further downstream away from any low pressure regions in the internal fuel chamber, thereby substantially reducing any detrimental impact of the low pressure regions on the distribution of the fuel flow to the plurality of fuel outlets. In certain embodiments, the plurality of fuel outlets may be positioned at an offset distance from a radial centerline through the internal fuel chamber. Furthermore, some embodiments of the swirl vane may position the plurality of fuel outlets at an axial distance of at least approximately ⅔ of a total axial distance from an upstream edge to a downstream edge of the internal fuel chamber. In these embodiments, as discussed in further detail below, each swirl vane injects the fuel more uniformly into the air flow path, thereby improving the uniformity of air-fuel mixing inside the fuel nozzle assembly. As a result, the disclosed fuel nozzle assemblies improve operation of the combustion system, e.g., gas turbine engine.

FIG. 1 is a block diagram of an embodiment of a turbine system 10 having a plurality of fuel nozzles 12 with improved air-fuel mixing to improve the combustion process, increase performance, reduce the possibility of flame holding, and reduce undesirable emissions. For example, as discussed below, each fuel nozzle 12 may include one or more modified swirl vanes (e.g., modified fuel outlet layout and/or modified fuel chamber shape) configured to improve pressure uniformity and eliminate or substantially reduce non-uniform pressure and flow in the fuel nozzle 12. The turbine system 10 may use liquid or gas fuel, such as natural gas and/or a hydrogen rich synthetic gas, to drive the turbine system 10. As depicted, one or more fuel nozzles 12 intake a fuel 14, mix the fuel with air, and distribute the air-fuel mixture into a combustor 16. The fuel nozzles 12 may inject a fuel-air mixture into the combustor 16 in a suitable ratio for optimal combustion, emissions, fuel consumption, and power output. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including a compressor 24. The compressor 24 also includes blades coupled to the shaft 22. As the shaft 22 rotates, the blades within the compressor 24 also rotate, thereby compressing air 26 from an air intake through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of turbine system 10.

Figure 2:
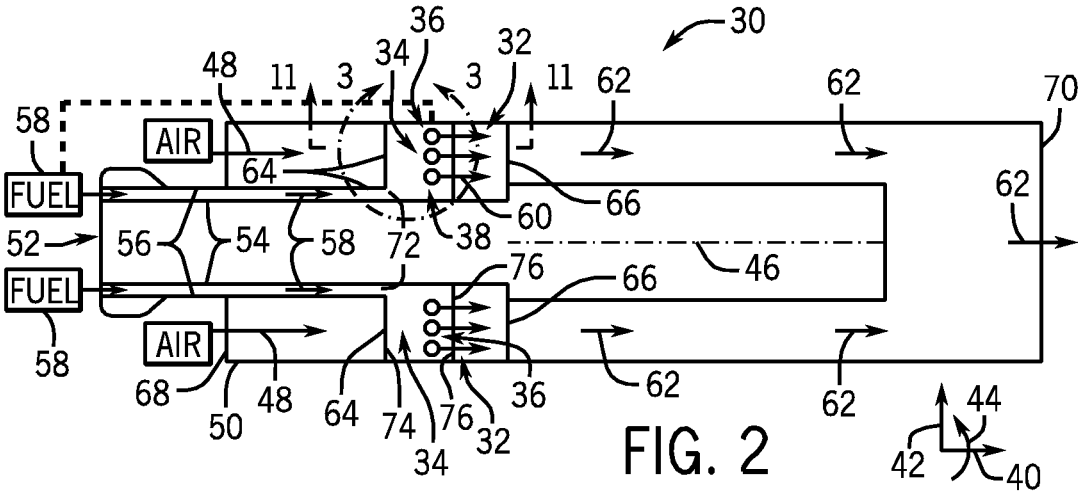
FIG. 2 is a cross-sectional side view of an embodiment a fuel nozzle assembly having a plurality of swirl vanes configured to provide improved air-fuel mixing.

FIG. 2 is a cross-sectional side view of an embodiment of a fuel nozzle assembly 30 having a plurality of swirl vanes 32 configured to provide improved air-fuel mixing. As discussed in detail below, each swirl vane 32 has a fuel chamber 34 with a plurality of fuel outlets 36 (e.g., 1 to 50 outlets) arranged in a layout, configuration, or region 38, which is configured to provide a substantially uniform fuel pressure across the plurality of fuel outlets 36. The illustrated fuel nozzle assembly 30 may be mounted in the combustor 16 of the gas turbine engine 10, and thus may represent the fuel nozzle 12 of FIG. 1. For purposes of discussion, reference may be made to an axial direction or axis 40, a radial direction or axis 42, and a circumferential direction or axis 44 relative to a longitudinal axis 46 of the fuel nozzle assembly 30. As illustrated, the fuel nozzle assembly 30 has the plurality of swirl vanes 32 disposed within an air flow path 48 between a shroud 50 and a hub 52. Furthermore, the hub 52 includes an inner hub portion 54 and an outer hub portion 56, wherein a fuel flow path 58 extends between the inner and outer hub portions 54 and 56. In certain embodiments, the fuel flow path 58 (shown in dashed line) extends along the shroud 50 to the swirl vane 32. Each swirl vane 32 receives fuel from the fuel flow path 58, expands the fuel flow in the fuel chamber 34, uniformly distributes the fuel flow to the plurality of fuel outlets 36, and injects the fuel as fuel injection streams 60 into the air flow path 48. Due to the uniform fuel distribution to the fuel outlets 36 inside of the fuel chamber 34, the injected fuel streams 60 are more uniformly distributed into the air flow path 48 to provide a substantially uniform air-fuel mixture 62. In this manner, the swirl vanes 32 substantially improves air-fuel mixing within the fuel nozzle assembly 30, thereby improving combustion, reducing emissions, and reducing the possibility of flame holding. Furthermore, the swirl vanes 32 are configured to impart a swirl or circumferential rotation 44 to the air flow path 48 and the air fuel-mixture 62 to improve air-fuel mixing within the fuel nozzle assembly 30. In certain embodiments, the fuel nozzle assembly 30 may include 2 to 20 swirl vanes 32, which may be evenly spaced circumferentially 44 about the longitudinal axis 46.

As illustrated, each swirl vane 32 extends radially 42 from the hub 52 to the shroud 50, and extends axially 40 from an external leading edge 64 to an external trailing edge 66 (e.g., relative to air flow path 48). Furthermore, each swirl vane 32 is disposed in the air flow path 48 axially 40 between an air inlet 68 and an air-fuel outlet 70. Internally, each swirl vane 32 includes a fuel inlet 72, the fuel chamber 34, and the plurality of fuel outlets 36. Furthermore, the fuel chamber 34 includes an internal upstream edge 74 and an internal downstream edge 76 (e.g., relative to the fuel flow path 58). In the illustrated embodiment, the fuel chamber 34 is located closer to external leading edge 64 than the external trailing edge 66. However, other embodiments may position the fuel chamber 34 centrally between the leading and trailing edges 64 and 66, or closer to the leading edge 66. Regardless of the position of the fuel chamber 34, the plurality of fuel outlets 36 are positioned in the region 38 to improve the fuel pressure uniformity and fuel distribution across the plurality of outlets 36. For example, as discussed in further detail below, the fuel outlets 36 may be positioned axially 40 off center relative to the internal upstream edge 74 and the internal downstream edge 76 of the fuel chamber 34, such that the fuel outlets 36 are positioned further away from any low fuel pressure region (e.g., potential recirculation zone) within the fuel chamber 34. In certain embodiments, the fuel outlets 36 may be disposed substantially closer to the internal downstream edge 76 as opposed to the internal upstream edge 74 within the fuel chamber 34.

Figure 3:
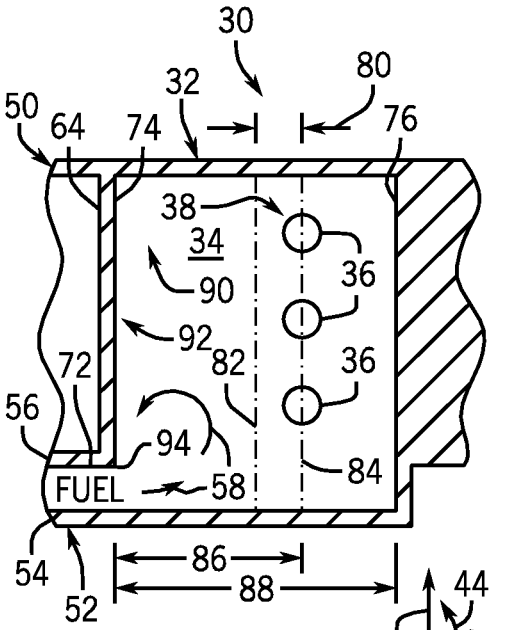
FIG. 3 is a cross-sectional side view of an embodiment of the swirl vane, taken within line 3-3 of FIG. 2, illustrating a plurality of fuel outlets at offset positions relative to a radial centerline within an internal fuel chamber of the swirl vane.

FIG. 3 is a cross-sectional side view of an embodiment of the swirl vane 32, taken within line 3-3 of FIG. 2, illustrating a plurality of fuel outlets 36 at axial offset positions or distance 80 relative to a radial centerline 82 within the internal fuel chamber 34 of the swirl vane 32. In particular, the radial centerline 82 is disposed axially 40 equidistant to the internal upstream edge 74 and the internal downstream edge 76, while the plurality of fuel outlets 36 are centered along a radial axis 84 between the radial centerline 82 and the internal downstream edge 76. As illustrated, the radial axis 84 of the plurality of fuel outlets 36 is disposed at the offset distance 80 from the radial centerline 82 to substantially improve pressure uniformity upstream of fuel outlets 36, and thus fuel flow distribution, among the plurality of fuel outlets 36. In other words, the plurality of fuel outlets 36 are disposed at an axial distance 86, which is greater than approximately 50 percent of a total axial distance 88 between the internal upstream edge 74 and the internal downstream edge 76 of the fuel chamber 34. In certain embodiments, the fuel outlets 36 are all axially 40 centered along the radial axis 84, such that all of the fuel outlets 36 are disposed at the same axial distance 86. In other embodiments, as discussed in further detail below, the fuel outlets 36 may not be centered along the radial axis 84, and thus may have different axial distances 86. However, in either configuration, the fuel outlets 36 are disposed at axial distances 86 greater than approximately 50, 55, 60, 65, 70, 75, 80, 85, 90, 95 or 100 percent of the total axial distance 88. For example, the axial distances 86 may be approximately 55 to 100 or 60 to 95 or 65 to 80 percent of the total axial distance 88. By further example, the axial distances 86 may be a minimum of approximately ⅔ (i.e., 66.6 percent) of the total axial distance 88. Thus, in the depicted embodiment, the location of the fuel outlets 36 may be selected to move the fuel outlets 36 away from any low pressure region or recirculation zone 90 within the fuel chamber 34, such that the fuel outlets 36 are substantially uniformly fed fuel.

In the illustrated embodiment, the fuel chamber 34 has a substantially rectangular shape or boundary 92, which is defined by the internal upstream edge 74, the internal downstream edge 76, the shroud 50, and the hub 52. In other words, the internal upstream and downstream edges 74 and 76 may be substantially parallel to one another in the radial direction 42, and thus the total axial length 88 is substantially uniform in the radial direction 42 from the hub 52 to the shroud 50. As a result of this rectangular geometry, the inlet 72 may abruptly expand the fuel flow 58 into the fuel chamber 34 at an upstream edge, corner, or expansion point 94. For example, the edge 94 is at an intersection between the outer hub portion 56 and the internal upstream edge 74, which are substantially perpendicular to one another. The perpendicular intersection at the edge 74 may cause the low pressure region or recirculation zone 90 radially 42 outward from the hub 52 toward the shroud 50. As a consequence of this recirculation zone 90, the fuel pressure may be non-uniform in the radial direction 42 at locations closer to the internal upstream edge 74 of the fuel chamber 34. Thus, the axial distances 86 from the internal upstream edge 74 to the fuel outlets 36 is configured to ensure that the pressure is more uniform, and thus the fuel flow is more uniformly distributed to the fuel outlets 36.

Figure 4:
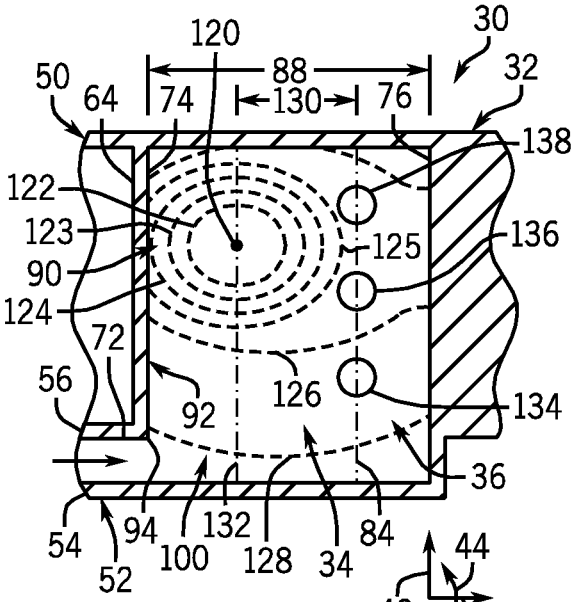
FIG. 4 is a cross-sectional side view of an embodiment of the swirl vane of FIG. 3, illustrating a static pressure distribution relative to the fuel outlets within the internal fuel chamber of the swirl vane.

FIG. 4 is a cross-sectional side view of an embodiment of the swirl vane 32 of FIG. 3, illustrating a static pressure distribution 100 relative to the fuel outlets 36 within the internal or interior fuel chamber 34 of the swirl vane 32. In the illustrated embodiment, the static pressure distribution 100 includes a center 120 surrounding by a plurality of pressure bands 122, 123, 124, 125, 126, and 128, which depict gradually increasing fuel pressure levels from the center 120 to the outermost band 128. The low pressure center 120 and at least the innermost band 122 are disposed in the recirculation zone 90 as discussed above with reference to FIG. 3. This type of pressure distribution may form as a result of large scale vortical fuel motion that may occur within the rectangular fuel chamber 34 of the swirl vane 32. The illustrated fuel outlets 36 are centered along the radial axial 84, which is disposed at an offset distance 130 downstream from a radial axis 132 extending through the low pressure center 120 of the static pressure distribution 100. Although embodiments of the fuel outlets 36 may be centered or non-centered along the radial axis 84, each fuel outlet 36 may be disposed at a minimum offset distance 130 downstream from the low pressure center 120 (i.e. a minimum distance from a minimum pressure point of the recirculation zone 90). For example, the minimum offset distance 130 may be greater than or equal to approximately 10, 20, 30, 40, 50, 60, 70, 80, or 90 percent of the total axial length 88 between the internal upstream and downstream edges 74 and 76 of the fuel chamber 34. In certain embodiments, the offset distance 130 may be approximately 5 to 95, 10 to 50, or 15 to 25 percent of the total axial length 88. As a result, the offset distance 130 positions the fuel outlets 36 in an area of the fuel chamber 34 having a more uniform pressure distribution.

In contrast, if the fuel outlets 36 were positioned along the radial axis 132 through the low pressure center 120, then the fuel outlets 36 would be subjected to substantially different fuel pressures. For example, if positioned along axis 132, the fuel outlets 36 may include one or more fuel outlets at or near the low pressure center 120, and one or more fuel outlets at or near each of the pressure bands 122, 123, 124, 125, 126, and 128. As a result, fuel outlets 36 in the lowest pressure regions (e.g., 120 and 122) would receive substantially less fuel than fuel outlets 36 in the highest pressure regions (e.g., 128). In turn, the fuel injection streams 60 into the air flow path 48 would be substantially non-uniform, leading to poor air-fuel mixing, drops in performance, possible flame holding, and greater emissions. However, the disclosed embodiments avoid these low pressure regions by offsetting the fuel outlets 36 away from the low pressure center 120. For example, the illustrated embodiment may include fuel outlets 36 only in one or two pressure bands, such as fuel outlet 134 between bands 126 and 128 and fuel outlets 136 and 138 between bands 125 and 126. In other embodiments, the fuel outlets 36 may include 2 to 50 fuel outlets at the offset distance 130 within one or more pressure bands.

Figure 5:
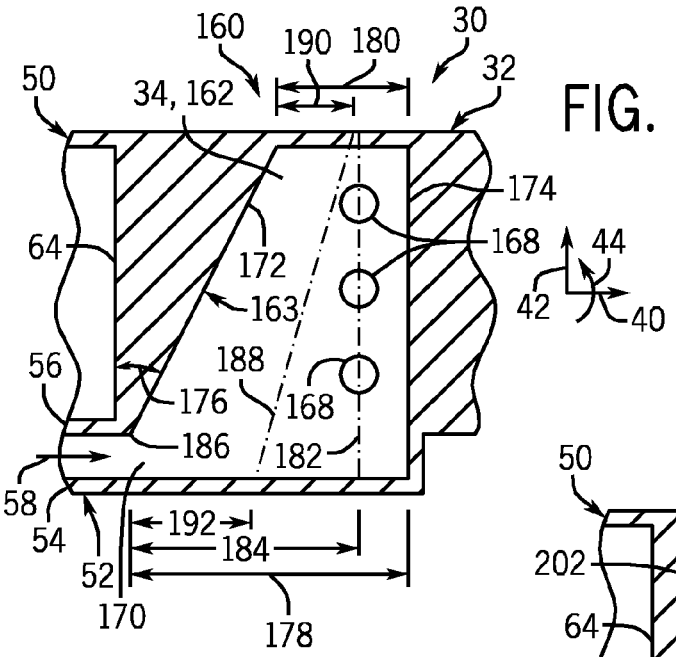
FIG. 5 is a cross-sectional side view of an embodiment of the swirl vane, taken within line 3-3 of FIG. 2, illustrating an internal fuel chamber of the swirl vane having a tapered upstream edge.

As discussed above, using a modified fuel outlet layout may allow the positioning of fuel outlets 36 away from regions of large scale vortical motion inside the fuel chamber 34. Additionally, employing a fuel chamber 34 having a modified shape may reduce this vortical motion altogether to provide greater pressure uniformity. For example, FIG. 5 is a cross-sectional side view of an embodiment of the swirl vane 32, taken within line 3-3 of FIG. 2, illustrating an embodiment of the internal fuel chamber 34 of the swirl vane 32 having a non-rectangular shape. As illustrated, the swirl vane 32 is a modified swirl vane 160, and the fuel chamber 34 is a modified fuel chamber 162. In particular, the illustrated fuel chamber 162 is a quadrilateral shaped chamber, such as a trapezoidal shaped chamber, which includes an interior boundary 163. The boundary 163 of the fuel chamber 162 receives fuel 58 through a fuel inlet 170, and injects the fuel 58 into the air flow path 48 through fuel outlets 168. The boundary 162 is defined by the shroud 50, the hub 52, an interior upstream edge 172, and an interior downstream edge 174. In the illustrated embodiment, the interior upstream edge 172 is tapered or angled (e.g., tapered upstream edge) relative to the radial axis 42, thereby substantially filling the recirculation zone 90 illustrated in FIGS. 3 and 4. In other words, the interior upstream edge 172 substantially guides the fuel flow 58 toward the plurality of fuel outlets 168 to provide more uniform distribution through the outlets 168, and thus more uniform air-fuel mixing in the air flow path 48.

As illustrated in FIG. 5, the interior upstream edge 172 of the fuel chamber 34, 162 diverges away from the leading edge 64 of the swirl vane 32,160 at an angle 176, yielding a fuel chamber 162 having a different inner axial length 178 (i.e., near the hub 52) and outer axial length 180 (i.e., near the shroud 50). In other words, the angle 176 may be defined relative to the radial axis or direction 42. The interior upstream edge 172 of the fuel chamber 162 may extend away from the leading edge 64 of the swirl vane 32, 160 at an angle 176 of approximately 1 to 85, 5 to 60, or 10 to 45 degrees. For example, the angle 176 may be greater than or equal to approximately 5, 10, 15, 20, 25, 30, 35, 40, 45, 50, 60, 70, or 80 degrees. In certain embodiments, the angle 176 may be selected to provide the fuel chamber 34, 162 with a particular non-uniform ratio between the inner and outer axial lengths 178 and 180. For example, the outer axial length 180 of the fuel chamber 34, 172 may be approximately 10 to 90, 15 to 75, or 25 to 50 percent of the inner axial length 178. In some embodiments, the outer axial length 180 may be less than or equal to approximately 15, 20, 25, 30, 35, 40, 45, 50, 55, 60, 65, 70, 75, 80, or 85 percent of the inner axial length 178. In one embodiment, the outer axial length 180 may be approximately ⅔ (e.g., 66.6 percent) of the inner axial length 178. Again, the angle 176 may substantially fill the recirculation zone 90, and reduce the possibility of low fuel pressures or poor fuel flow being directed toward the radially 42 outward fuel outlets 168. Thus, the fuel chamber 34, 162 substantially contracts from the hub 52 to the shroud 50, thereby helping to maintain suitable fuel pressure for the radially 42 outer fuel outlets 168.

In the depicted embodiment of FIG. 5, the plurality of fuel outlets 168 is substantially round and is disposed in a row along a radial axis 182 that is positioned at an axial distance 184 downstream from a point 186 along the interior upstream edge 172 (e.g., the point 186 along the upstream edge 176 that is nearest the hub 52, adjacent the fuel inlet 170). This axial distance 184 may be represented as a percentage of the inner axial length 178 of the fuel chamber 34, 162. For example, the fuel outlets 168 may be centered about the radial axis 182 at the axial distance 184 of greater than or equal to approximately ⅔ (e.g., 66.6 percent) the inner axial length 178 of the fuel chamber 34, 162 downstream from the point 186 at the bottom of the interior upstream edge 172. In certain embodiments, the axial distance 184 may be approximately 55 to 95, 60 to 90, or 65 to 85 percent of the inner axial length 178. Furthermore, some embodiments of the fuel outlets 168 may be positioned anywhere downstream of the centerline 188 that connects a midpoint 190 of the outer axial length 180 and a midpoint 192 of the inner axial length 178. The illustrated shape of the fuel chamber 34, 162 is particularly beneficial in improving the pressure uniformity and flow distribution to the plurality of fuel outlets 168.

Figure 6:
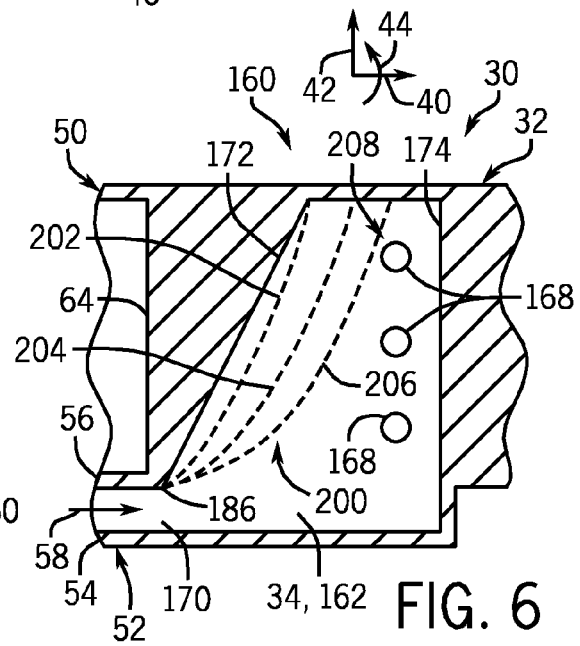
FIG. 6 is a cross-sectional side view of an embodiment of the swirl vane of FIG. 5, illustrating a static pressure distribution relative to the fuel outlets within the internal fuel chamber of the swirl vane.

FIG. 6 is a cross-sectional side view of an embodiment of the swirl vane 32, 160 of FIG. 5, illustrating a static pressure distribution 200 relative to the fuel outlets 168 within the internal fuel chamber 34, 162 of the swirl vane 32, 160. In the illustrated embodiment, the static pressure distribution 200 includes a plurality of pressure bands or lines 202, 204, and 206, which progressively increase in pressure from the interior upstream edge 172 toward the fuel outlets 168. In contrast to the pressure distribution 100 observed in FIG. 4 for the substantially rectangular fuel chamber 34, the chamber 160 of FIG. 6 substantially reduces or eliminates the recirculation zone 90 and provides a substantially uniform pressure region 208 across all of the fuel outlets 168. Again, the tapered shape of the interior upstream edge 172 substantially fills the zone 90, thereby reducing the possibility of large scale vortices to develop as the fuel flow 58 enters the chamber 162 through the fuel inlet 170. Rather than an abrupt 90 degree turn at the edge 94 of FIGS. 3 and 4, the edge 186 of FIGS. 5 and 6 provides a more gradual transition into the chamber 162. In other words, the tapered shape of the interior upstream edge 172 substantially reduces the pressure drop into the chamber 162, and gradually expands the fuel flow 58 to maintain pressure uniformity as well as uniform fuel distribution to the fuel outlets 168.

In general, FIGS. 7-10 depict a variety of fuel outlet layouts. The illustrations are intended to be exemplary and not exhaustive. It would be appreciated by one of ordinary skill in the art that many features from these figures might be employed individually or in combination within a single swirl vane or fuel nozzle embodiment. While these embodiments of fuel outlet layouts are depicted on a swirl vane of a particular shape (e.g., rectangular, tapered, etc.), the fuel outlet layouts described herein may be applicable to swirl vanes having other disclosed geometries as well. Additionally, while FIGS. 7-10 may demonstrate fuel outlets disposed at particular axial and radial positions on the swirl vane, it should be appreciated that the particular layouts described in these figures could be offset in an axial or radial direction according to the fuel outlet positioning schemes disclosed above.

Figure 7:
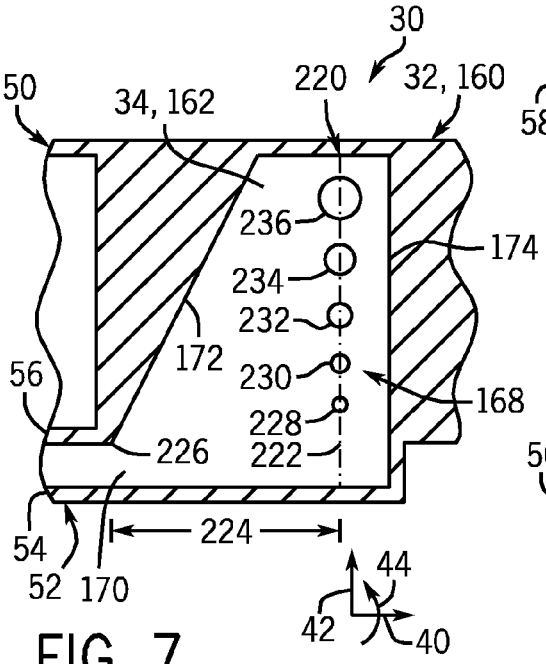
FIG. 7 is a cross-sectional side view of an embodiment of the swirl vane of FIG. 5, illustrating fuel outlets with varying diameter in a radial direction.

FIG. 7 is a cross-sectional side view of an embodiment of the swirl vane 32, 160 of FIG. 5, illustrating fuel outlets 168 with varying diameter (e.g., progressively changing in size) in the radial direction 42. The depicted embodiment includes a fuel outlet layout 220 with five round fuel outlets 168, which may be positioned in a radial row along a radial axis 222 at a distance 224 from a point or edge 226 between the outer hub portion 56 and the interior upstream edge 172 of the fuel chamber 162. The fuel outlets 168 include progressively larger fuel outlets 228, 230, 232, 234, and 236. For example, the fuel outlets 228, 230, 232, 234, and 236 may have diameters that progressively increase by approximately 1 to 50, 2 to 25, or 5 to 10 percent from one fuel outlet to another in the radial direction 42 from the hub 52 toward the shroud 50. In another embodiment, the fuel outlets 228, 230, 232, 234, and 236 may progressively decrease in diameter from the hub 52 toward the shroud 50. In other embodiments, the largest diameter fuel outlet may be positioned in the center of the row of fuel outlets (i.e., fuel outlet 232), and the diameter of each subsequent fuel outlet moving toward the hub 52 and the shroud 50 is smaller in size. In each embodiment, the distribution of differently sized fuel outlets 168 may be configured to improve uniformity of the fuel flow through the outlets 168 into the air flow path 48. Furthermore, the number, shape, and pattern of the fuel outlets 168 may vary from one implementation to another.

Figure 8:
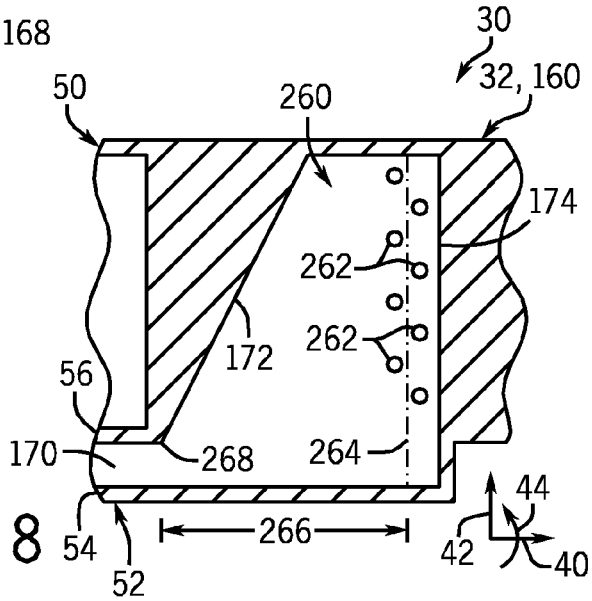
FIG. 8 is a cross-sectional side view of an embodiment of the swirl vane of FIG. 5, illustrating fuel outlets with a staggered arrangement.

FIG. 8 is a cross-sectional side view of an embodiment of the swirl vane 32, 160 of FIG. 5, illustrating fuel outlets 168 with a staggered arrangement or fuel layout 260. In the depicted embodiment, eight round fuel outlets 262 are organized into two radial rows disposed about a radial axis 264, which is positioned at an axial distance 266 from a point or edge 268 between the outer hub portion 56 and the interior upstream edge 172 of the fuel chamber 34, 162. Unlike fuel outlet layouts described above, the fuel outlets 262 of the depicted swirl vane 32, 160 are staggered axially upstream and axially downstream about the radial axis 264. Therefore, fuel outlets 262 axially upstream (e.g., leftward) of the radial axis 264 may be positioned approximately midway between two adjacent fuel outlets 262 axially downstream (e.g., rightward) of the radial axis 264. The depicted staggered arrangement 260 may be used to further improve the uniformity of fuel flow through the outlets 262 into the air flow path 48. In some embodiments, the staggered arrangement 260 may include 2 to 10 radial rows of staggered fuel outlets 262, and each radial row may include 2 to 20 fuel outlets 262.

Figure 9:
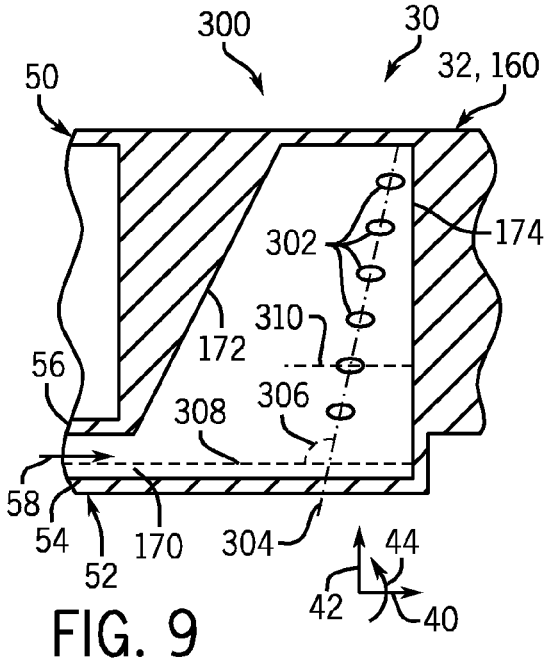
FIG. 9 is a cross-sectional side view of an embodiment of the swirl vane of FIG. 5, illustrating fuel outlets with elliptical shapes.

FIG. 9 is a cross-sectional side view of an embodiment of the swirl vane 32, 160 of FIG. 5, illustrating an angled arrangement or fuel layout 300 of fuel outlets 302 with elliptical shapes. In the illustrated embodiment, six elliptical outlets 302 are organized into a row about a line 304 disposed at an angle 306 relative to an axial axis 308, which is parallel to the axial axis 40 and/or the inner hub portion 54. The angle 306 may be approximately 1 to 45, 5 to 30, or 10 to 15 degrees. For example, the angle 306 may be equal to or greater than approximately 5, 10, 15, 20, 25, 30, 35, 40, or 45 degrees. Furthermore, each fuel outlet 302 has an elliptical shape that is elongated along a major axis 310, which may be oriented at an angle of approximately 0 to 90, 5 to 75, 10 to 60, or 15 to 45 degrees relative to the axial axis 40 and/or the inner hub portion 54. The depicted arrangement 300 may be used to further improve the uniformity of fuel flow through the outlets 302 into the air flow path 48. In some embodiments, the arrangement 300 may include 2 to 50 elliptical shaped fuel outlets 302. In other embodiments, the arrangement may include 2 to 50 fuel outlets 302 along the angled line 304, wherein the fuel outlets 302 are circular, elliptical, rectangular, triangular, airfoil or teardrop shaped, or any other suitable shape.

Figure 10:
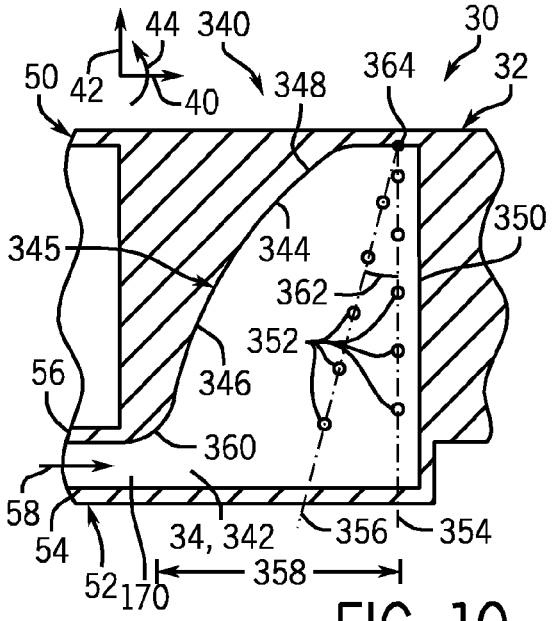
FIG. 10 is a cross-sectional side view of an embodiment of the swirl vane, taken within line 3-3 of FIG. 2, illustrating an internal fuel chamber of the swirl vane having a curved upstream edge and multiple rows of fuel outlets.

FIG. 10 is a cross-sectional side view of an embodiment of the swirl vane 32, taken within line 3-3 of FIG. 2, illustrating a converging arrangement 340 (e.g., converging rows) of fuel outlets 352 within an internal fuel chamber 34, 342 of the swirl vane 32. In the illustrated embodiment, the fuel chamber 34, 342 includes a curved upstream edge 344 configured to gradually expand (and drop the pressure of) the fuel flow 58 to provide a more uniform pressure and flow distribution across the fuel outlets 352. For example, the illustrated edge 344 has an S-shaped profile 345 having a first curved portion 346 and a second curved portion 348, which curve in opposite directions relative to one another. As illustrated, the first curved portion 346 curves radially away from the hub 52 toward the shroud 50, while the second curved portion 348 curves radially away from the shroud 50 toward the hub 52. However, the curved upstream edge 344 may have a variety of curvatures to control the fuel flow 58, pressure drop, and uniformity of pressure and flow within the chamber 34, 342. The illustrated fuel outlets 352 are organized into two rows along two intersecting lines 354 and 356. The first row is disposed along a radial line or axis 354 at an axial distance 358 from a point or edge 360 between the outer hub portion 56 and the upstream edge 344. The second row is disposed further upstream along a line 356 positioned at an angle 362 relative to the radial axis 354, such that the two lines 354 and 356 intersect at a point 364 near the shroud 50 of the fuel chamber 342. In certain embodiments, the angle 362 may be approximately 1 to 45, 5 to 30, or 10 to 15 degrees. Although the depicted embodiment includes only two rows of fuel outlets 352, other embodiments may include 2 to 10 rows of fuel outlets 352. Again, the depicted arrangement 340 may be used to further improve the uniformity of fuel flow through the outlets 352 into the air flow path 48.

Figure 11:
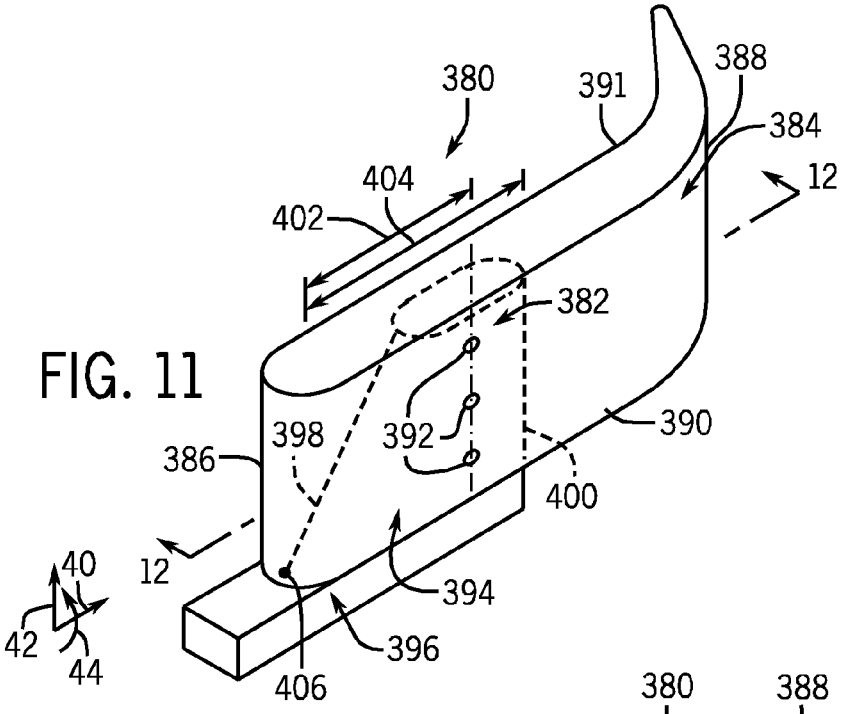
FIG. 11 is a perspective top view of an embodiment of the swirl vane of FIGS. 5 and 6.

FIG. 11 is a perspective top view of an embodiment of the swirl vane 32, 160 of FIGS. 5 and 6. In the illustrated embodiment, a swirl vane 380 includes an interior portion 382 and exterior portion 384. The exterior portion 384 of the swirl vane 380 includes a leading edge 386, a trailing edge 388, a front side 390, a back side 391, and a plurality of fuel outlets 392 disposed about the sides 390 and 391. The interior portion 382 of the swirl vane 380 includes a fuel chamber 394 coupled to a fuel flow path by a fuel inlet 396, wherein the fuel chamber 394 extends from the inlet 396 to the plurality of fuel outlets 392. The fuel chamber 394 includes an upstream edge 398 positioned facing the leading edge 386, as well as a downstream edge 400 positioned facing the trailing edge 388. As depicted, each side 390 and 391 of the swirl vane 380 has three fuel outlets 392 positioned at a distance 402 of at least approximately ⅔ (e.g., 66.6 percent) of a total axial length 404 of the fuel chamber 394 downstream from a point 406 along the upstream edge 398 of the fuel chamber 394. In certain embodiments, the fuel outlets 392 are disposed at axial distances 402 greater than approximately 50, 55, 60, 65, 70, 75, 80, 85, 90, or 95 percent of the total axial distance 404. For example, the axial distances 402 may be approximately 60 to 95 or 65 to 80 percent of the total axial distance 404. Furthermore, the fuel outlets 392 may be oriented at an angle relative to the sides 390 and 391, as discussed below with reference to FIG. 12.

Figure 12:
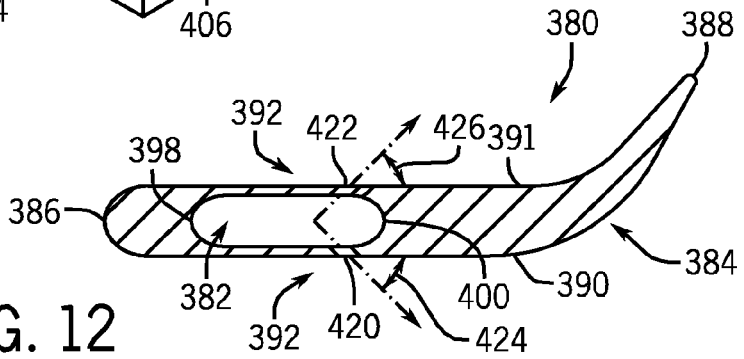
FIG. 12 is a cross-sectional top view of an embodiment of the swirl vane of FIG. 11, taken along line 12-12.

FIG. 12 is a cross-sectional top view of an embodiment of the swirl vane 380 of FIG. 11, taken along line 12-12. As illustrated, the fuel outlets 392 include angled fuel outlets 420 disposed along the side 390, and angled fuel outlets 422 disposed along the side 391. Although only one fuel outlet 392 is illustrated per side 390 and 391, embodiments of the swirl vane 380 may include 2 to 50 angled fuel outlets 420 and 422. The angled fuel outlet 420 is oriented at an angle 424 relative to the side 390 of the swirl vane 380, and the angled fuel outlet 422 is oriented at an angle 426 relative to the side 391 of the swirl vane 380. The fuel outlets 420 and 422 may be angled downstream relative to the air flow path 48 at a variety of angles 424 and 426. For example, the angles 424 and 426 may be approximately 0 to 90, 5 to 75, 10 to 60, or 15 to 45 degrees relative to the respective sides 390 or 392 of the swirl vane 380. Furthermore, the angles 424 and 426 may be equal or different from one another. Again, the features depicted in FIGS. 11 and 12 may be used to further improve the uniformity of fuel flow through the outlets 392 into the air flow path 48.

Technical effects of the invention include an improvement in pressure distribution uniformity near the surface of swirl vanes during turbo machine operation. Vortical motion of the fuel inside of the swirl vanes may produce regions of substantially lower pressure near the center of the fuel chamber, especially for swirl vanes having rectangular fuel chambers. By positioning the fuel outlets of the swirl vanes away from the center of the swirl vane, the fuel outlets may be displaced from these low pressure regions, and the pressure distribution near the fuel outlets may become more uniform. Additionally, by modifying the shape of the fuel chamber of the swirl vane from rectangular to a tapered or curved, the vortical motion of the fuel may be substantially suppressed. Finally, the dimensions and layout of the fuel outlets of the swirl vane may be modified to further improve the uniformity of fuel flow from the fuel outlets during system operation. Furthermore, the disclosed techniques of displacing the fuel outlets from the center of the swirl vane, modifying the shape of the fuel chamber, and modifying the dimensions and layout of the fuel outlets may be used individually or in combination to improve fuel pressure and fuel flow uniformity. By improving the uniformity of the pressure distribution and fuel flow the quality of the air-fuel mixture may be improved, leading to lower $NO_x$ emissions, higher efficiency, reduced pressure fluctuations, and improved performance for the turbo machine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a turbine fuel nozzle, comprising:

a hub having an axis;

a shroud surrounding the hub along the axis;

an air flow path between the hub and the shroud;

a fuel flow path; and a swirl vane extending between the hub and the shroud in a radial direction relative to the axis, wherein the swirl vane comprises a fuel inlet coupled to the fuel flow path, a fuel chamber extending from the fuel inlet, and a plurality of fuel outlets extending from the fuel chamber to the air flow path, wherein the plurality of fuel outlets is positioned at an axial distance of between 55 and 100 percent of an axial length of the fuel chamber downstream from an upstream point along an upstream edge of the fuel chamber, wherein the upstream edge extends radially away from the fuel inlet over a total radial distance, wherein at least half of the total radial distance of the upstream edge is oriented at an acute angle away from the radial direction between the hub and the shroud.

2. The system of claim 1, wherein the fuel flow path extends along the hub to the swirl vane.

3. The system of claim 1, wherein the fuel flow path extends along the shroud to the swirl vane.

4. The system of claim 1, wherein the upstream point is disposed adjacent the fuel inlet into the fuel chamber.

5. The system of claim 1, wherein the acute angle is between 5 and 60 degrees relative to the radial direction, and the total radial distance of the upstream edge is oriented at the acute angle away from the radial direction between the hub and the shroud.

6. The system of claim 1, wherein the acute angle of the upstream edge extends radially away from the fuel inlet gradually in a downstream direction of fuel flow from the fuel inlet.

7. The system of claim 6, wherein the upstream edge is a tapered edge that tapers linearly in the radial direction between the hub and the shroud.

8. The system of claim 6, wherein the upstream edge is a curved edge that curves in the radial direction between the hub and the shroud.

9. The system of claim 6, wherein the acute angle is at least approximately 30 degrees relative to the radial direction.

10. The system of claim 1, wherein the plurality of fuel outlets has a staggered arrangement in the radial direction.

11. The system of claim 1, wherein the plurality of fuel outlets progressively changes in size in the radial direction.

12. The system of claim 1, comprising a turbine combustor or a turbine engine having the turbine fuel nozzle.

13. The system of claim 1, wherein the plurality of fuel outlets is positioned at the axial distance of greater than or equal to approximately ⅔ of the axial length of the fuel chamber downstream from the upstream point along the upstream edge of the fuel chamber.

14. A system, comprising:

a fuel nozzle, comprising:

a hub having an axis;

a shroud disposed about the hub;

an air flow path between the hub and the shroud;

a fuel flow path; and a vane disposed between the hub and the shroud, wherein the vane comprises a fuel inlet coupled to the fuel flow path, a fuel chamber coupled to the fuel inlet and extending between the hub and the shroud, and a plurality of fuel outlets coupled to the fuel chamber between the hub and the shroud, wherein an upstream edge of the fuel chamber extends radially away from the fuel inlet over a total radial distance, wherein at least half of the total radial distance of the upstream edge is oriented at an acute angle away from a radial direction between the hub and the shroud.

15. The system of claim 14, wherein all of the plurality of fuel outlets are offset by at least a minimum distance from a minimum pressure point of a recirculation zone in the fuel chamber, and the minimum distance is configured to increase uniformity of fuel flow through the plurality of fuel outlets.

16. The system of claim 14, wherein all of the plurality of fuel outlets are positioned at an axial distance of between 55 and 100 percent of an axial length of the fuel chamber downstream from an upstream point along the upstream edge of the fuel chamber.

17. The system of claim 14, wherein an axial length of the fuel chamber changes from a first axial length at the hub to a second axial length at the shroud, wherein the first and second axial lengths are different from one another, wherein a shorter one of the first and second axial lengths is less than 75 percent of a longer one of the first and second axial lengths.

18. The system of claim 14, wherein the acute angle of the upstream edge extends radially away from the fuel inlet gradually in a downstream direction of fuel flow from the fuel inlet.

19. The system of claim 14, wherein the upstream edge is a tapered edge that tapers linearly in the radial direction between the hub and the shroud.

20. The system of claim 14, wherein the upstream edge is a curved edge that curves in the radial direction between the hub and the shroud.

21. A system, comprising:

a fuel nozzle swirl vane, comprising:

an exterior extending about an axis from a leading edge to a trailing edge relative to an air flow path;

an interior fuel chamber having an upstream edge facing the leading edge and a downstream edge facing the trailing edge;

a fuel inlet into the interior fuel chamber adjacent the upstream edge; and a plurality of fuel outlets extending from the interior fuel chamber to the exterior, wherein the plurality of fuel outlets is positioned at a distance of between 55 and 100 percent of a length of the interior fuel chamber downstream from an upstream point along the upstream edge of the fuel chamber, wherein the upstream edge extends radially away from the fuel inlet over a total radial distance, wherein at least half of the total radial distance of the upstream edge is oriented at an acute angle away from a radial direction between opposite sides of the fuel nozzle swirl vane, the radial direction is relative to the axis along the fuel nozzle swirl vane, and the acute angle is oriented gradually in a downstream direction away from the fuel inlet.

22. The system of claim 21, wherein the upstream edge of the interior fuel chamber is acutely angled relative to the leading edge of the exterior in the radial direction between the opposite sides of the fuel nozzle swirl vane.

23. The system of claim 21, wherein all of the plurality of fuel outlets are offset by at least a minimum distance from a minimum pressure point of a recirculation zone in the interior fuel chamber, and the minimum distance is configured to increase uniformity of fuel flow through the plurality of fuel outlets.

* * * * *